US005722444A

United States Patent [19]

Prokopenko et al.

[11] Patent Number: 5,722,444

[45] Date of Patent: Mar. 3, 1998

[54] RIGID ULTRASONIC RADIATION PLATE ASSEMBLY SYSTEMS FOR ULTRASONIC CLEANING TANKS

[75] Inventors: Alex V. Prokopenko; Robert B. Gulay, both of Hamilton, N.J.

[73] Assignee: Trident Technologies Unlimited, Inc., Hamilton, N.J.

[21] Appl. No.: 621,649

[22] Filed: Mar. 26, 1996

[51] Int. Cl.[6] ..... B08B 3/10

[52] U.S. Cl. ..... 134/184; 68/355; 310/348; 366/127

[58] Field of Search ..... 134/184, 1, 1.1, 134/1.2, 1.3; 310/348, 368; 68/355; 366/127, 111, 114

[56] References Cited

U.S. PATENT DOCUMENTS

| | | | |
|---|---|---|---|
| 2,995,347 | 8/1961 | Rich | 366/127 |
| 3,151,846 | 10/1964 | George | 68/3 SS |
| 3,198,489 | 8/1965 | Finch | 366/127 |
| 3,301,535 | 1/1967 | Brown | 134/184 |
| 3,339,132 | 8/1967 | Schafft | 366/127 |
| 3,561,734 | 2/1971 | Antonevich | 366/127 |
| 3,730,489 | 5/1973 | Morita | 134/184 |
| 5,119,840 | 6/1992 | Shibata | 134/184 |

FOREIGN PATENT DOCUMENTS

| | | | |
|---|---|---|---|
| 3147143 | 3/1973 | Germany | 134/184 |
| 54-16855 | 2/1979 | Japan | 134/184 |

*Primary Examiner*—Frankie L. Stinson
*Attorney, Agent, or Firm*—Mark A. Garzia

[57] ABSTRACT

A rigid ultrasonic radiating plate system assembly designed for fastening to bottom/planes of an ultrasonic cleaning tank. As an initial sub-assembly, the plate has selected threaded bolts/studs which are fitted/welded in a pattern perpendicular to the bottom of the plate. This plate sub-assembly component is fitted through the selected tank plane (bottom/wall), by simultaneously matching the entire bolt/stud hole pattern through to the outside of the tank and on the inside of the tank against the surface of the bottom/wall.

20 Claims, 1 Drawing Sheet

RIGID ULTRASONIC RADIATION PLATE ASSEMBLY SYSTEMS FOR ULTRASONIC CLEANING TANKS

SUMMARY OF THE INVENTION

Figure 1:
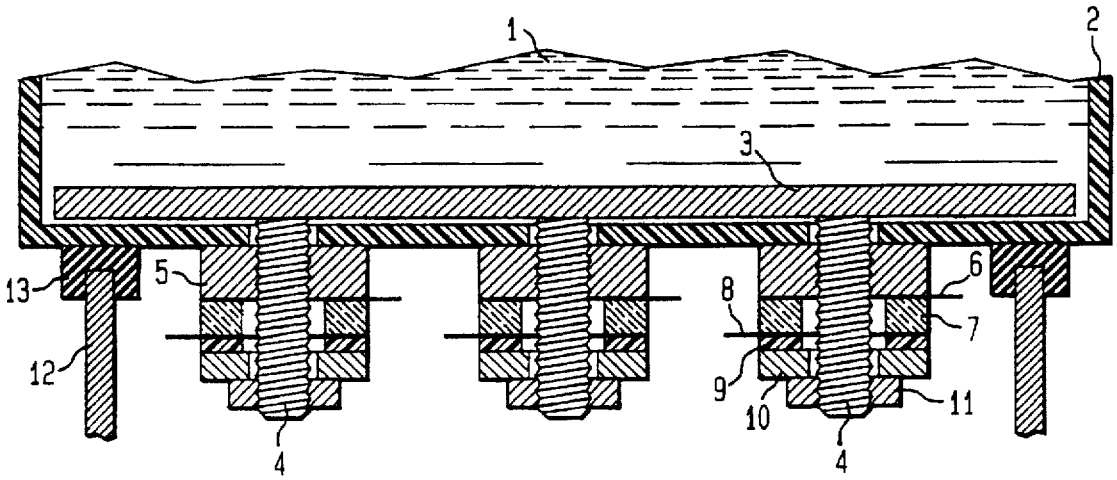

A Rigid Ultrasonic Radiating Plate System Assembly uniquely designed for fastening to bottom/wall planes of ultrasonic cleaning tank applications. As an initial sub-assembly, the plate has selected threaded bolts/studs which are fitted/welded in a pattern perpendicular to the identified bottom of the plate. This plate sub-assembly component is fitted through the selected tank plane (bottom/wall), by simultaneously matching the entire bolt/stud hole pattern through, to the outside of tank and on the inside of tank against the skin surface of the e.g., inside to tank bottom.

Assembly is completed by installing onto the outside of tank, as applicable, on to each threaded bolt/stud penetrating through the tank outside: front mass, Found electrode, piezocrystal ring, hot electrode insulator, backmass and nut. The entire plate sub-assembly sandwiches, via bolt/studs, through the tank wall, all components outside with the rigid plate inside the tank and tank skin. Tightening of transducers, etc., sealing with sealant between the rigid plate and bottom inside the tank and between bottom of the tank outside and front masses of transducers makes the tank watertight. Therefore, neither a large hole opening for a plate assembly nor a flange attachment of the rigid plate to the tank is required.

In addition, in order to circumvent the possibility of deflection, as a consequence of combined weight pressure of cleaning liquid and extra heavy parts placed into the cleaning tank, a specially designed support frame is mounted under the tank bottom. This support frame member, placed into vertical shear strength position, borders the ultrasonic radiation plate assembly perimeter outside of the tank. Additionally, an elastic soft type material acting as an isolator, is placed in-between the support frame member, and the underside of tank.

By use of the isolator in this manner/material, the bottom of the tank with the ultrasonic radiation plate system operates undisturbed by not having its oscillations energy dissipate, due to direct friction contact with the support frame. In this manner, the operation simultaneously continues to compensate the force of weight of the tank, parts and liquid within the tank.

This invention relates/allows using an ultrasonic cleaning tank, having a bottom/wall that is made of different materials than the tank itself for ultrasonic cleaning applications. The reason and purpose for this invention/design are to have a sound radiating surface that is harder and more resistant to cavitation, than the material of the tank itself. Thereby, allowing options for using different materials (e.g., plastic, aluminum, etc.) and their varieties of manufacturing for ultrasonic cleaning tank applications.

Briefly, there exist a tank application whereby its bottom is substantially cut open to accommodate a one piece slip in assembly which utilizes ultrasound cleaning means. This one piece assembly is bordered with a flange which accommodates numerous holes to allow for fastening into the tank. However, the disadvantage of this design is that at the flange connection, the edge of the tank and the edge of the plate need to be thick enough to obtain rigidity stiffness in the flange and to be able to compress the packing gasketing material adequately to achieve watertight sealing conditions. This existing method makes the assembled tank and plate cumbersome as well as heavy. In addition, requiring a large perimeter opening through the tank bottom, followed by numerous holes around this large perimeter for flange fastening to tank bottom.

By comparison, the new herein submitted Rigid Ultrasonic Radiation Plate Assembly System is flat (without flange) and utilizes only minimum hole allowances for each bolt/stud in the bottom for plate (inside tank) sandwiching of ultrasonic assembly components outside the tank.

Importantly, as compared to the status quo and the submitted herein Rigid Ultrasonic Radiation Plate Assembly System design invention opens the possibilities to using a variety of materials; i.e., plastics, aluminum, etc., for the construction of ultrasonic cleaning tanks and their method of manufacturing processes; e.g., pre-molding, precast, stampings, etc., having a desirable, practical, economical and reliable for specific application uses. All this, while achieving, as a system, quality performance success. The aforementioned is achievable with the rigid/wear resistant; e.g., stainless steel, coated steel, titanium, hard group plastics, etc., Radiation Plate Assembly System invention, as submitted herein.

This patent submission also submits the application for where, in the event, should a rigid plate not be compatible with welding, or the rigid plate is not metal, the rigid plate should have holes only. In this case, assembly of the plate to the bottom of the tank, transducers, etc., is made by application of threaded tress head screws from inside the tank through the bottom to the outside, wherein the same assembly design sandwich rational is used/applies.

In either design to obtain watertight sealing, sealant should be placed between plate and bottom of the tank, between bottom of the tank and front masses of sandwiched transducers, and between heads of screws and rigid plate. Sealant should be resistant to the cleaning solution used in the tank, and should be transparent for ultrasound waves.

This invention provides a solution to important practical problems. It is now possible to build an ultrasonic cleaning tank with a hard bottom plate, where thickness, both of the plate and the tank could be any.

This allows for a light pre-molded plastic tank to have radiating metal bottom or side plate, and have the same durability as a heavy, hard to fabricate, form and weld steel tank. In addition, in order to circumvent the possibility of deflection, as a consequence of combined weight pressure of cleaning liquid and extra heavy parts placed into the cleaning tank, a specially designed support frame is mounted under the tank bottom. This support frame member, placed into vertical shear strength position, borders the ultrasonic radiation plate assembly perimeter outside of the tank. Additionally, an elastic soft type material, acting as an isolator, is placed in-between the support frame member, and the underside of tank.

The following description takes into account accompanying drawings in which: FIG. 1 is a cross section of a tank with a cleaning solution inside depicting one embodiment of this submitted invention; where, the rigid plate has welded studs perpendicular to its horizontal plane bottom rigid plate assembly, penetrating through the bottom of the tank where transducers, etc., mounting is based on the threaded studs and, as final, locking nut in place. There is also shown a support frame at the bottom which is isolated from the tank bottom by soft isolators (e.g., rubber).

Figure 2:
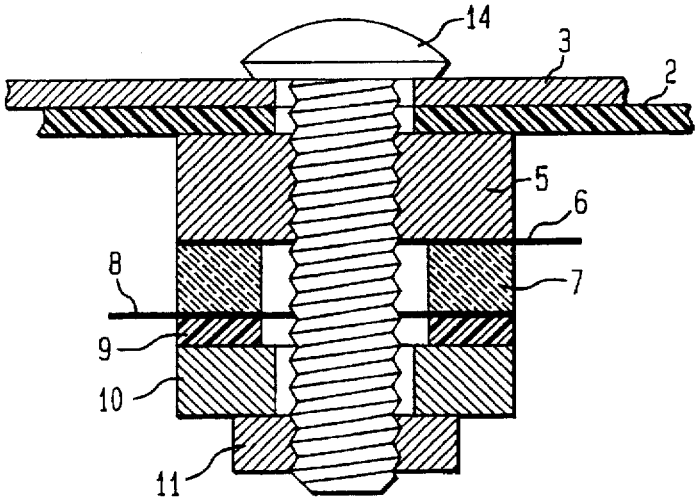

FIG. 2, depicts a single transducer, etc., assembly on a threaded bolt. This bolt also provides the sandwiching assembly capability of the rigid plate, transducer, etc., to the bottom of the tank. In either design as depicted: FIG. 1 or FIG. 2, the transducer can be a piezocrystal or magnetostrictive type groups.

Referring to the drawings, and particularly to FIG. 1, as illustrated is a liquid (1) within the tank (2). A radiating rigid plate (3) with welded to the bottom studs (4) that come through the holes in the bottom of the tank (2). The front mass (5) of the transducer has a female threaded center hole. Tightening of this mass (5) on stud (4) accomplishes tight sealing of the hole in the bottom of the tank (2). The sealant should be spread on the surfaces of the rigid plate (3), tank (2) and from mass (5) before compression by tightening of the screw joint.

There is also shown a typical sandwich transducer, assembled on the stud (4), that contains ground electrode (6), piezocrystal ring (7), hot electrode (8), insulator (9), backmass (10), and nut (11). The support frame (12) and soft elastic isolator (13), compensate the action of the weight of liquid parts in the tank itself. Both the support frame (12) and the soft isolator neither allows deflection of the tank bottom nor prevents the ultrasonic vibrations of the bottom. In addition, the support frame (12), and soft elastic insulators do not dissipate energy of oscillation(s) by friction in the place of contact of the frame and bottom of the tank.

FIG. 2, illustrates attaching a rigid plate (3) to the bottom of the tank (2) by a truss headed bolt/stud (14). In this case, sealant, resistant to cleaning solution, should be placed between tress head and rigid plate (3), between the rigid plate (3) and the bottom of the tank (4), and between the bottom of the tank (4) and front mass (5) of the transducer before tightening mass (5) on bolt (14).

We claim:

1. An ultrasonic washing apparatus, comprising:

a) a plastic tank having sides and a bottom for containing a cleaning liquid, said tank bottom having a plurality of openings;

b) a generally rigid plate that overlays substantially the entire tank bottom, for assisting in providing structural support to said tank, the rigid plate having a plurality of studs extending from one side thereof, said studs being positioned to align with said openings in the bottom of the tank, the studs passing therethrough when said plate is placed on the bottom of the tank;

c) means for imparting an ultrasonic oscillation to said plate by communicating with at least one of said plurality of studs; and d) means for securing said oscillation imparting means to said plate and tank.

2. The ultrasonic washing apparatus of claim 1, further comprising a support frame mounted under the tank bottom in a vertical shear strength position for supporting the washing apparatus.

3. The ultrasonic washing apparatus of claim 2, further comprising a elastometric material placed between the support frame member and the underside of the tank for isolating said tank.

4. The ultrasonic washing apparatus of claim 3 wherein said tank bottom and said rigid plate have a substantially rectangular profile.

5. The ultrasonic washing apparatus of claim 4 wherein said plurality of studs comprises at least three studs arranged in a line and equi-distantly spaced along the longitudinal axis of said rectangular plate.

6. The ultrasonic washing apparatus of claim 4, wherein said means for oscillating is a piezoelectric transducer that communicates with at least one of said plurality of studs.

7. The ultrasonic washing apparatus of claim 6, wherein said securing means also secures said piezoelectric transducer.

8. The ultrasonic washing apparatus of claim 7, wherein said studs are threaded and said attachment means comprises nuts that are screwed on to said threaded studs.

9. The ultrasonic washing apparatus of claim 1, wherein said rigid plate is comprised of stainless steel.

10. The ultrasonic washing apparatus of claim 1, wherein said studs are threaded and said attachment means comprises nuts that are screwed on to said threaded studs.

11. The ultrasonic washing apparatus of claim 1, further comprising sealant disposed between said rigid plate and said bottom of the tank for assisting in providing a liquid-tight seal proximate each of said plurality of openings.

12. The ultrasonic washing apparatus of claim 1, wherein said means for oscillating is a magneto restrictive transducer that communicates with at least one of said plurality of studs.

13. The ultrasonic washing apparatus of claim 1, wherein said means for oscillating is a piezoelectric transducer that communicates with at least one of said plurality of studs.

14. The ultrasonic washing apparatus of claim 1 wherein said tank bottom and said plate have a polygonally-shaped surface area.

15. The ultrasonic washing apparatus of claim 1 wherein said tank bottom and said plate each have a substantially oval-shaped surface area.

16. The ultrasonic washing apparatus of claim 1 wherein said plurality of openings comprise at least two openings positioned at strategically selected locations that optimize the cleaning action of the ultrasonic apparatus.

17. An ultrasonic washing apparatus, comprising:

a) a plastic tank having a bottom boundary and at least two side boundaries for containing a cleaning liquid, at least one of said boundaries having a plurality of openings;

b) a generally rigid plate having first and second planar sides with surface areas approximately the size of said at least one of said boundaries, the rigid plate having a plurality of studs extending from said second planar side thereof, said studs being positioned to align with said openings in said one of said boundaries, the studs passing therethrough when said second planar side is placed flat against said one of said boundaries;

c) means for imparting an ultrasonic oscillation to said plate by communicating with at least one of said plurality of studs; and d) means for securing said oscillation imparting means to said plate and tank for assisting in providing structural support to said tank and for sealing said openings in said at least one of said boundaries.

18. An ultrasonic transducer assembly for use in an ultrasonic cleaning apparatus, said cleaning apparatus having a tank for containing a cleaning liquid, said tank including a plurality of boundaries, the ultrasonic transducer assembly comprising:

a rigid plate having first and second extended flat sides, said second extended flat side being positioned against the interior side of said at least one of said boundaries so that the first extended flat side faces at least a portion of the cleaning liquid, the rigid plate being sized to cover substantially the entire surface area of said at least one of said boundaries;

an ultrasonic transducer positioned on the outer side of said at least one of said boundaries; and means for attaching said ultrasonic transducer to said rigid plate, in which said at least one of said boundaries is clamped between the rigid plate and the transducer, thereby forming a leak-proof assembly.

19. The ultrasonic transducer assembly of claim 18 further comprising a support frame mounted under the tank for supporting the tank and reducing deflections.

20. The ultrasonic transducer assembly of claim 19 further comprising means for isolating said tank from external deflections, said means being situated between said tank and said support frame.

* * * * *